US006705706B2

(12) United States Patent
Browning et al.

(10) Patent No.: US 6,705,706 B2
(45) Date of Patent: Mar. 16, 2004

(54) ARRANGEMENTS OF INTERCONNECT CIRCUIT AND FLUID DROP GENERATORS

(75) Inventors: Robert N. K. Browning, Corvallis, OR (US); Matt G Driggers, Vancouver, WA (US); Ralph L. Stathem, Lebanon, OR (US); Mark Daniel Tucker, Corvallis, OR (US); Patrick G Mahoney, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/342,736

(22) Filed: Jan. 15, 2003

(65) Prior Publication Data

US 2003/0103094 A1 Jun. 5, 2003

Related U.S. Application Data

(63) Continuation of application No. 09/967,567, filed on Sep. 28, 2001.

(51) Int. Cl.[7] ..... B41J 2/14; B41J 2/16; B41J 2/05; B41J 2/175

(52) U.S. Cl. ..... 347/50; 345/58; 345/87

(58) Field of Search ..... 347/49, 50, 57–59, 347/85–87

(56) References Cited

U.S. PATENT DOCUMENTS

| | | | | |
|---|---|---|---|---|
| 5,363,134 A | * 11/1994 | Barbehenn et al. | ..... | 347/49 |
| 5,411,343 A | 5/1995 | Childers | ..... | 347/50 |
| 5,610,642 A | 3/1997 | Nobel et al. | ..... | 347/50 |
| 5,748,209 A | 5/1998 | Chapman et al. | ..... | 347/50 |
| 6,273,554 B1 | 8/2001 | Mc Ardle et al. | ..... | 347/49 |
| 6,280,017 B1 | 8/2001 | Miyauchi | ..... | 347/49 |
| 6,371,597 B1 | 4/2002 | DeMeerleer et al. | ..... | 347/50 |
| 2001/0015744 A1 | 8/2001 | Feinn et al. | ..... | 347/87 |

FOREIGN PATENT DOCUMENTS

| | | | |
|---|---|---|---|
| EP | 0940257 A2 | 9/1999 | ..... B41J/2/16 |
| EP | 1095780 A1 | 10/2000 | ..... B41J/2/175 |
| WO | WO98/52762 A3 | 11/1998 | ..... B41J/2/01 |
| WO | WO98/52762 A2 | 11/1998 | ..... B41J/2/01 |

OTHER PUBLICATIONS

International Search Report dated Sep. 28, 2001 re International Application No. PCT/US 02/27350 filed Aug. 27, 2002.

* cited by examiner

*Primary Examiner*—Juanita Stephens

(57) ABSTRACT

An ink jet print cartridge having a compact electrical interconnect structure that includes a plurality of pairs of columnar arrays of electrical contact areas disposed on a rear wall of the print cartridge and electrically connected to ink drop generators arranged in primitive groups.

6 Claims, 13 Drawing Sheets

FIG.12
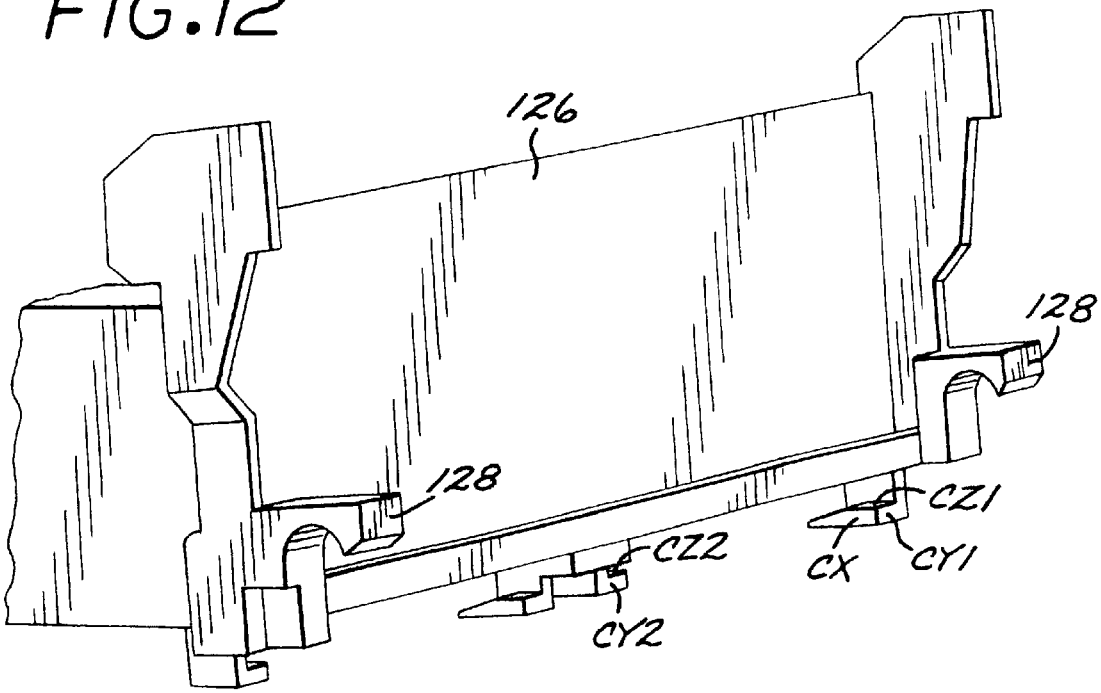
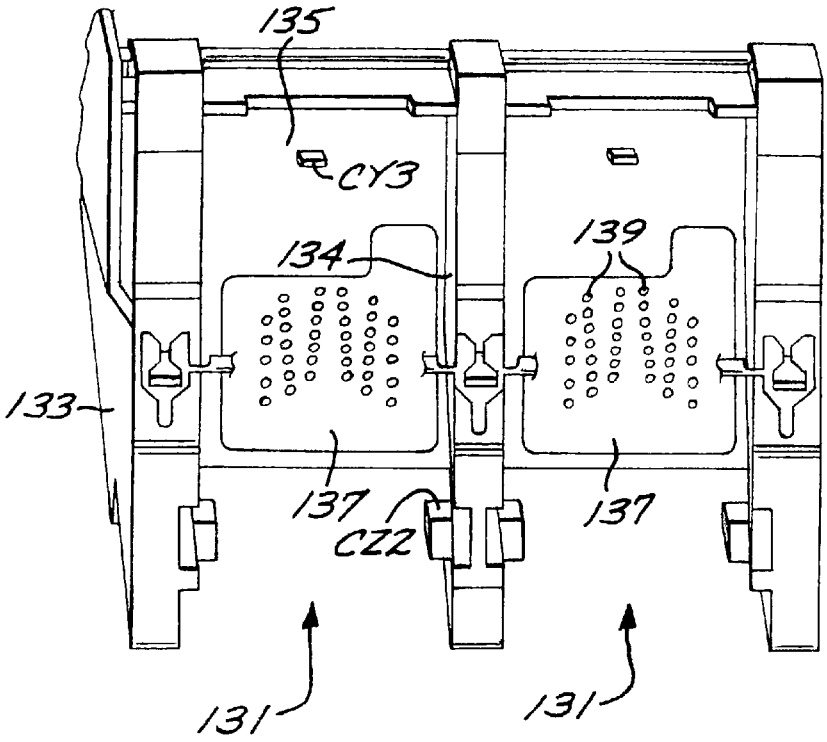
FIG.13

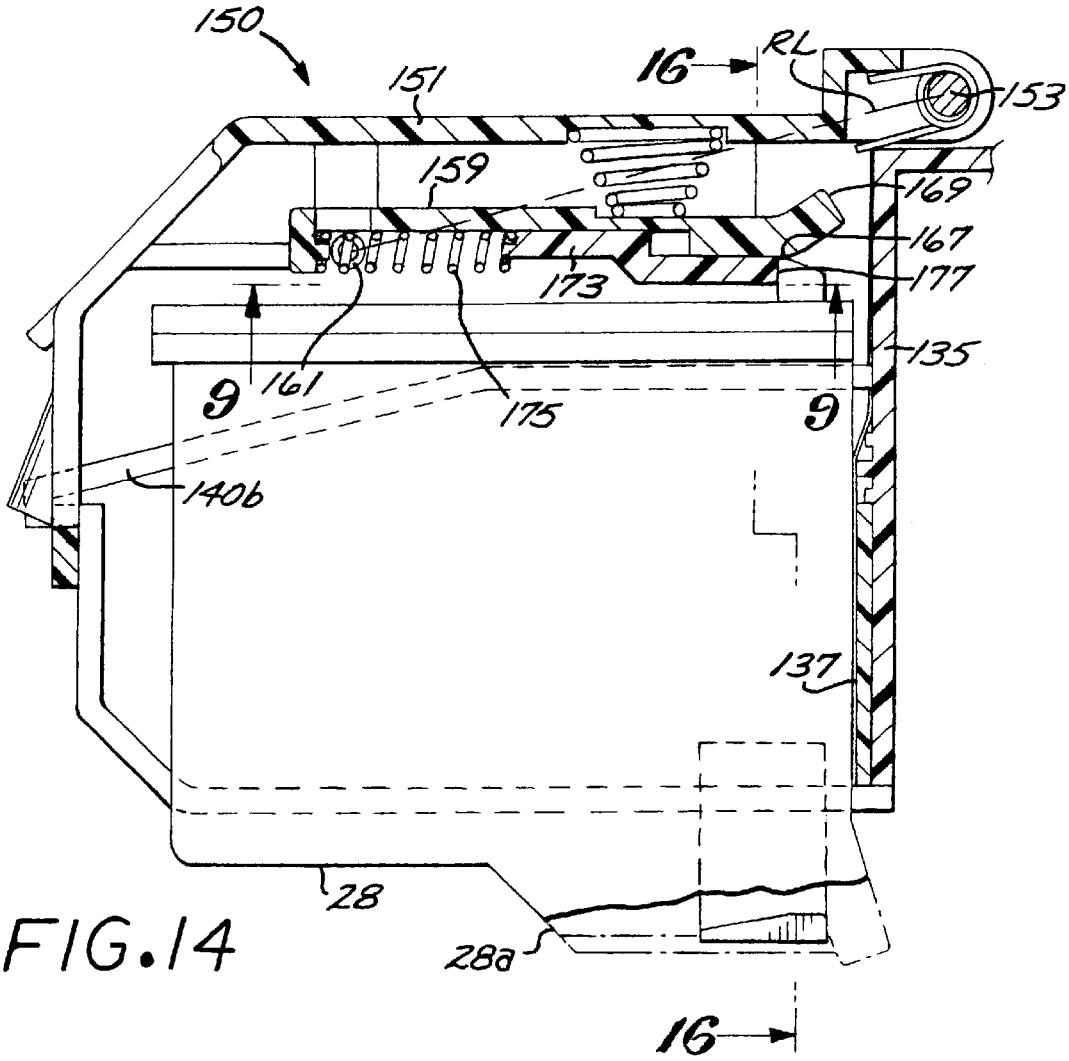
FIG.14
FIG.15
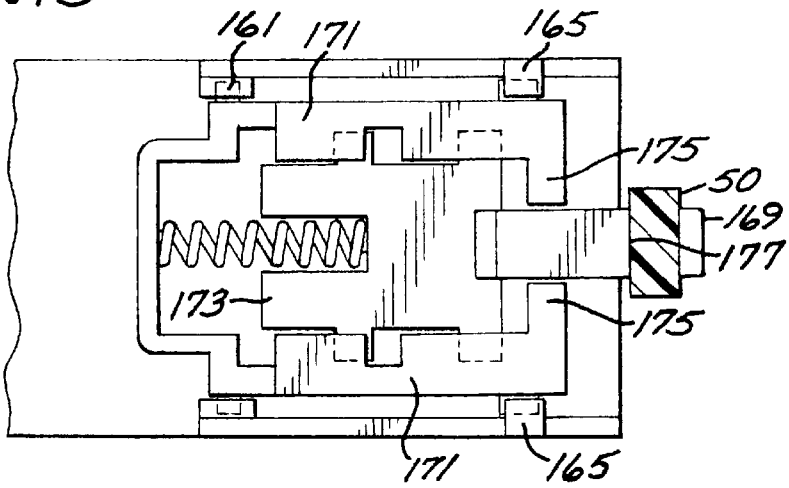

ARRANGEMENTS OF INTERCONNECT CIRCUIT AND FLUID DROP GENERATORS

CROSS REFERENCE TO RELATED APPLICATION(S)

This is a continuation of copending application number Ser. No. 09/967,567 filed on Sep 28, 2001, which is hereby incorporated by reference herein.

BACKGROUND OF THE INVENTION

The disclosed invention relates generally to fluid ejecting devices, and more particularly to a flexible interconnect circuit for a fluid ejecting device.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more print cartridges each having ink ejecting nozzles. The print carriage traverses back and forth over the surface of the print medium, and the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481. In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

Certain ink jet printers employ disposable print cartridges that are replaced when empty, and a consideration with such printers is the need for a reliable electrical interface between a print cartridge and the printer in which it is installed.

BRIEF DESCRIPTION OF THE DRAWINGS

The advantages and features of the disclosed invention will readily be appreciated by persons skilled in the art from the following detailed description when read in conjunction with the drawing wherein:

FIG. 12 is a schematic partial rear perspective view of the print carriage of FIG. 10, with the cartridges and the latch assemblies removed.

FIG. 13 is a schematic partial front perspective view of the print carriage of FIG. 10, with the cartridges and the latch assemblies removed.

FIG. 14 is a schematic sectional elevational view of a chute and latch assembly of the print carriage of FIG. 10.

FIG. 15 is a schematic plan view of a pivoting clamp of the latch assembly of the print carriage of FIG. 10.

DETAILED DESCRIPTION

Figure 1:
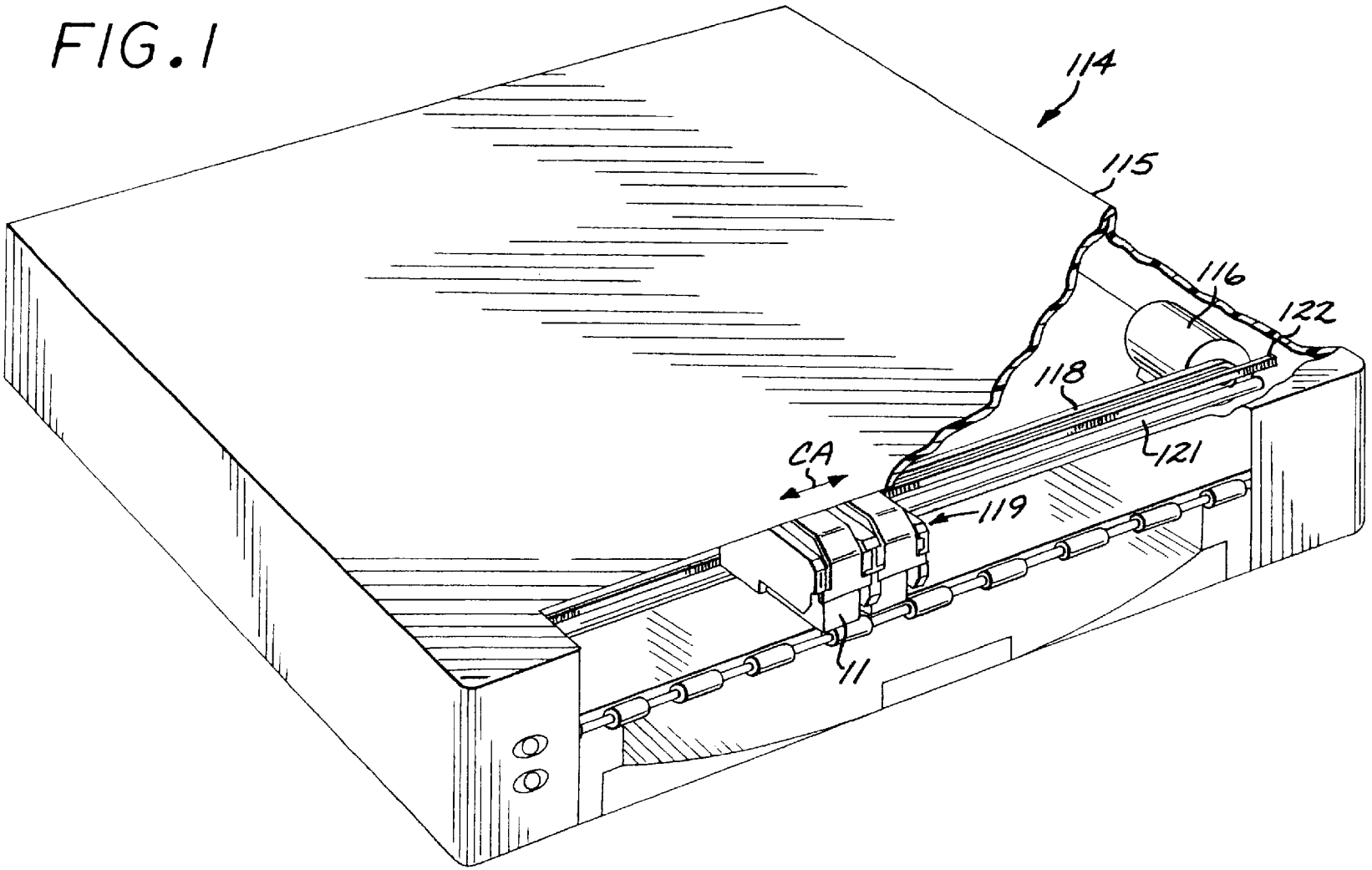
FIG. 1 is a schematic partial cut away perspective view of a printer having a movable carriage in which at least one print cartridge can be installed.

In the following detailed description and in the several figures of the drawing, like elements are identified with like reference numerals.

Referring now to FIG. 1, schematically depicted therein is an ink jet printer 114 partially cut away and with its front loading door removed. The printer includes a case or housing 115 and carriage drive motor 116 mounted on a chassis. The motor drives a belt 118 back and forth as the drive motor reverses direction. The drive belt 118 is attached to a print carriage 119 that scans laterally back and forth along a carriage scan axis CA from left to right and right to left. The print carriage 119 contains one or more externally similar thermal ink jet print cartridges 11 located side by side. For example, one print cartridge contains black ink while another has three ink chambers containing magenta, yellow and cyan inks. The horizontal scanning motion of the print carriage 119 is guided by a slider rod 121. Located in the rear of the carriage 119 is an encoder, not shown, that reads a position encoder strip 122 and provides information of the location of the print carriage 119 along the carriage axis CA.

Figure 2:
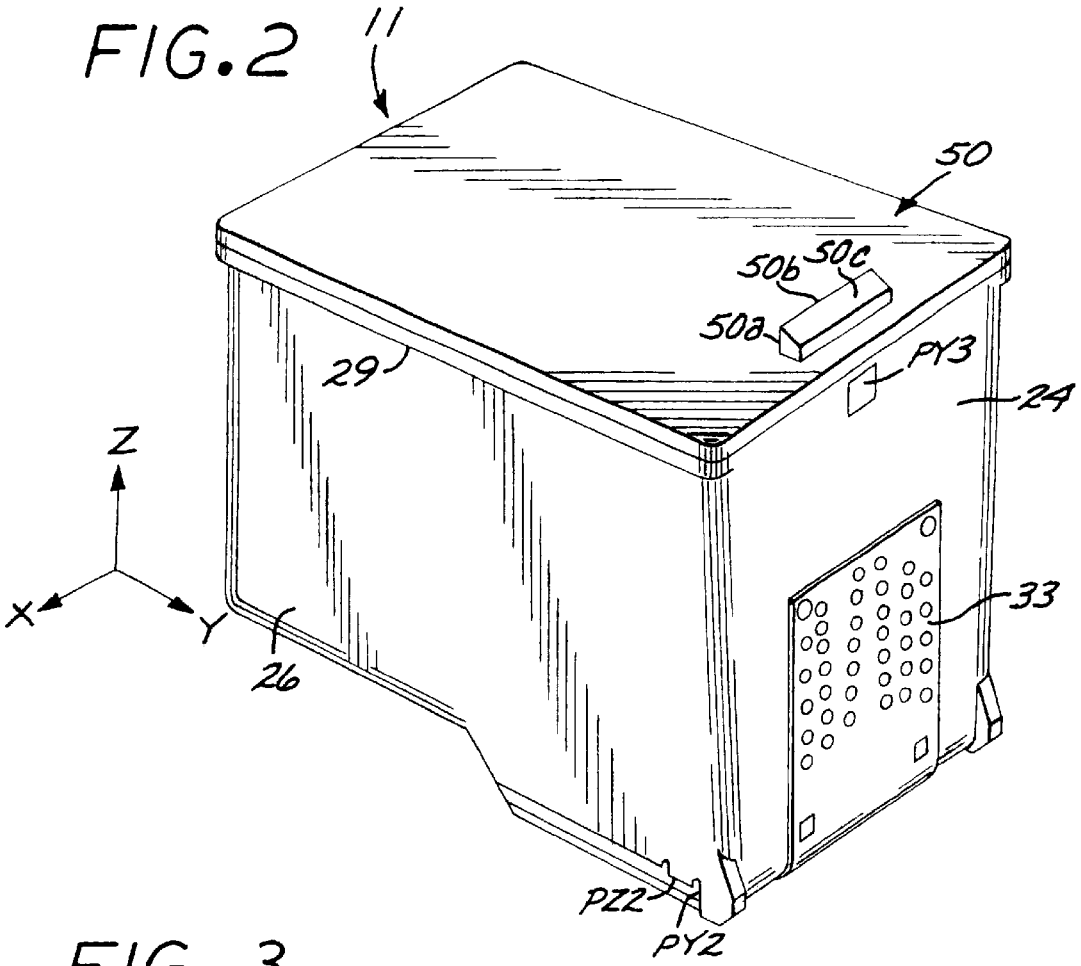
FIG. 2 is a schematic perspective view of an embodiment of an ink jet print cartridge that employs the invention.
Figure 10:
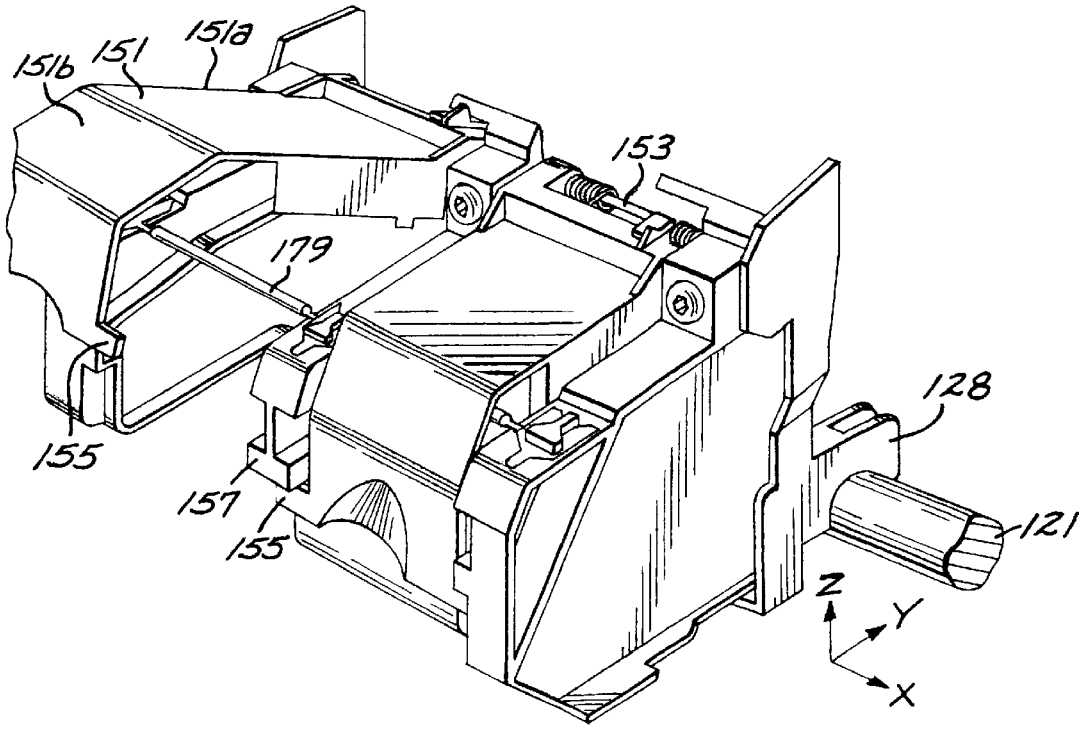
FIG. 10 is a schematic perspective view of the print carriage of the printer of FIG. 1.
Figure 11:
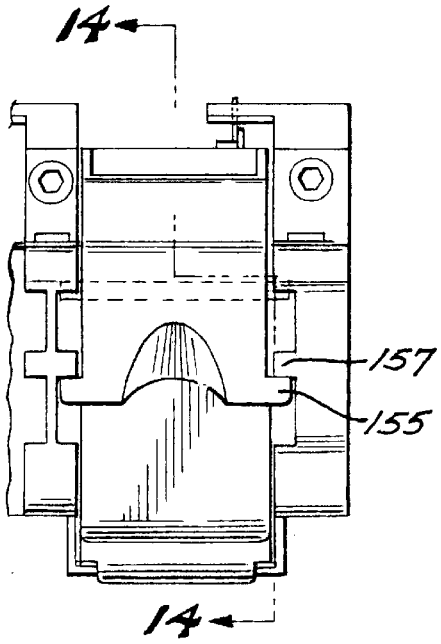
FIG. 11 is a schematic front elevational view of a chute and latch of the print carriage of FIG. 10.

The print carriage 119 includes a cartridge latching system that consistently and accurately positions the print cartridges 11 relative to an orthogonal coordinate system shown in FIGS. 2 and 10. The X axis is parallel to the carriage scan axis. The Y axis is parallel to and opposite a paper advance path which for example extends horizontally out of the printer 114, such that the X and Y axes define a horizontal plane. The Z axis extends vertically, orthogonal to the XY plane.

Figure 3:
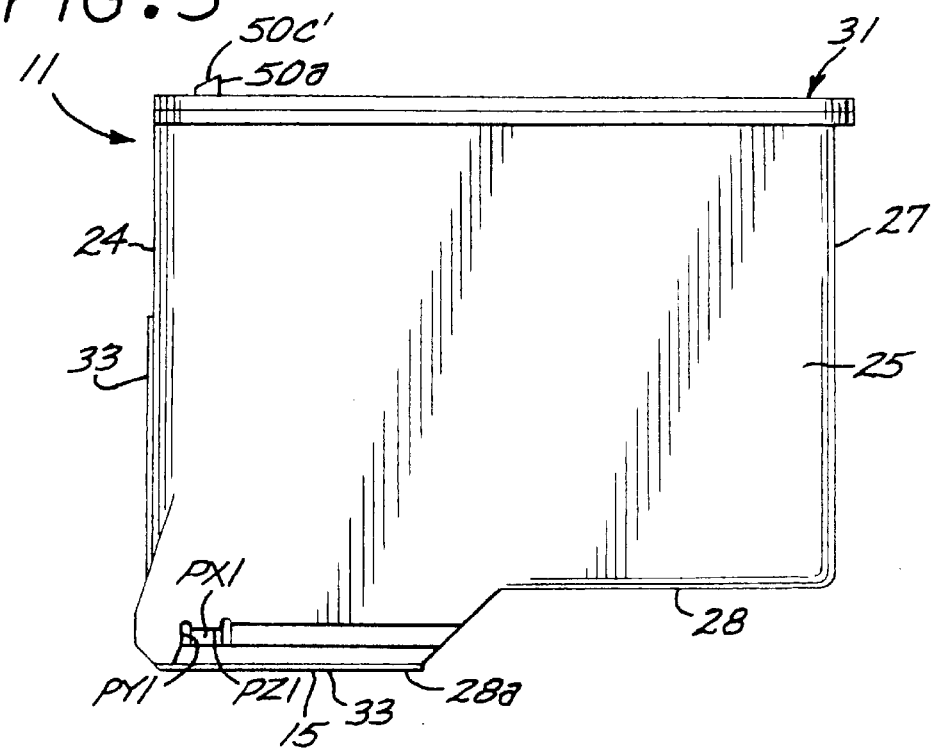
FIG. 3 is a schematic side elevational view of the ink jet print cartridge of FIG. 2.
Figure 4:
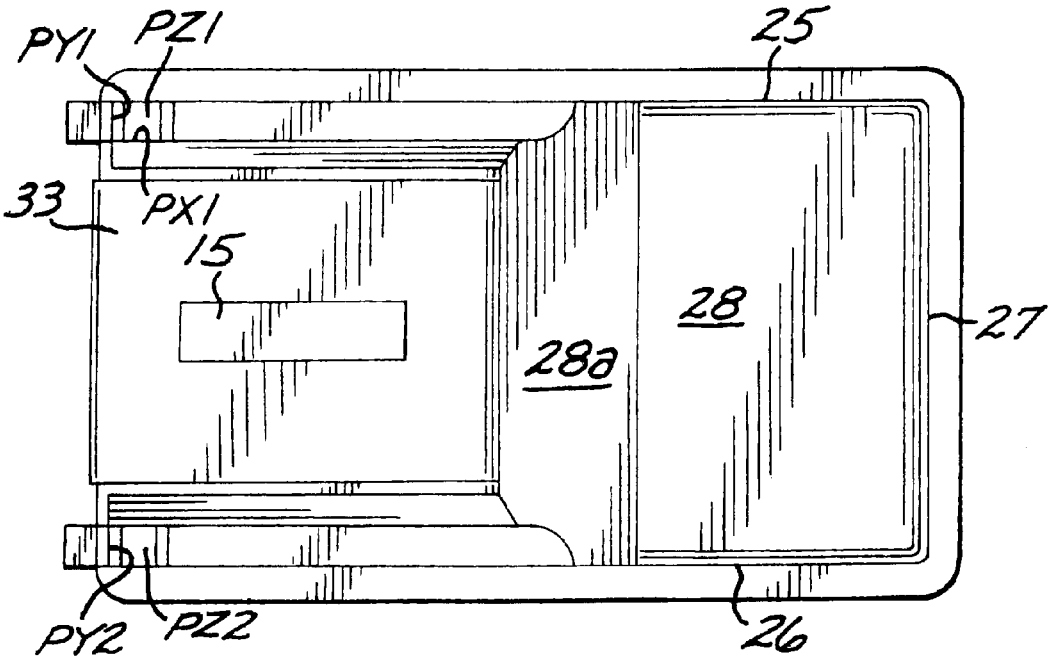
FIG. 4 is a schematic bottom plan view of the ink jet print cartridge of FIG. 2.

Referring now to FIGS. 2–4, the print cartridge 11 more particularly includes a print cartridge body comprised of a rear wall 24, a left side wall 25, a right side wall 26, a front wall 27, and a bottom wall 28 that includes a snout section 28*a* that supports an ink jet printhead 15. A top wall or lid 31 is attached to the upper edges of the front, side, and rear walls, and includes margins or lips 29 that extend beyond the front and side walls. A latch catch or feature 50 is disposed on the lid 31 close to the top boundary of the rear wall 24. The latch feature 50 extends upwardly from the top wall 31 and includes a front latch surface 50*a* and a rearwardly extending surface 50*c* that intersects the top of the front latch surface 50 at an edge surface 50*b*. By way of illustrative example, the front latch surface 50*a* is perpendicular to the lid 31 while the rearwardly extending surface 50*c* is a ramped surface that extends downwardly and rearwardly from the top of the front latch surface 50*a*. Alternatively, the rearwardly extending surface of the latch feature can comprise a horizontal surface 50*c*' as illustrated in FIG. 3. As described further herein, a latch pushes on a top portion of the latch feature 50. Depending upon implementation that top portion is the edge surface 50*b* or the horizontal surface 50*c*'.

Located in the vicinity of the intersection of the left side wall 25, rear wall 24 and snout 28*a* are a printhead cartridge X axis datum PX1, a first printhead cartridge Y axis datum PY1, and a first printhead cartridge Z axis datum PZ1. Located in the vicinity of the intersection of the right side wall 26, rear wall 24 and snout 28*a* are a second printhead cartridge Y axis datum PY2 and a second printhead cartridge Z axis datum PZ2. A third printhead cartridge Y axis datum PY3 is located in the upper portion of the rear wall 24. The print cartridge Y axis datums generally comprise lands that are configured to be generally orthogonal to the Y axis when the cartridge is installed in the print carriage 40. The print cartridge Z axis datums comprise lands that are configured to be generally orthogonal to the Z axis when the print cartridge is installed in the print carriage 119. The print cartridge X axis datum comprises a land that is configured to be generally orthogonal to the X axis when the print cartridge is installed in the print carriage 119. As described further herein, the datums of the cartridge engage corresponding datums in the carriage.

Disposed on the rear wall 24 and on the snout section 28*a* of the bottom wall 28 is a flexible circuit 33 that wraps around the intersection of such walls and provides electrical interconnection between the printer and the printhead 15.

Figure 5:
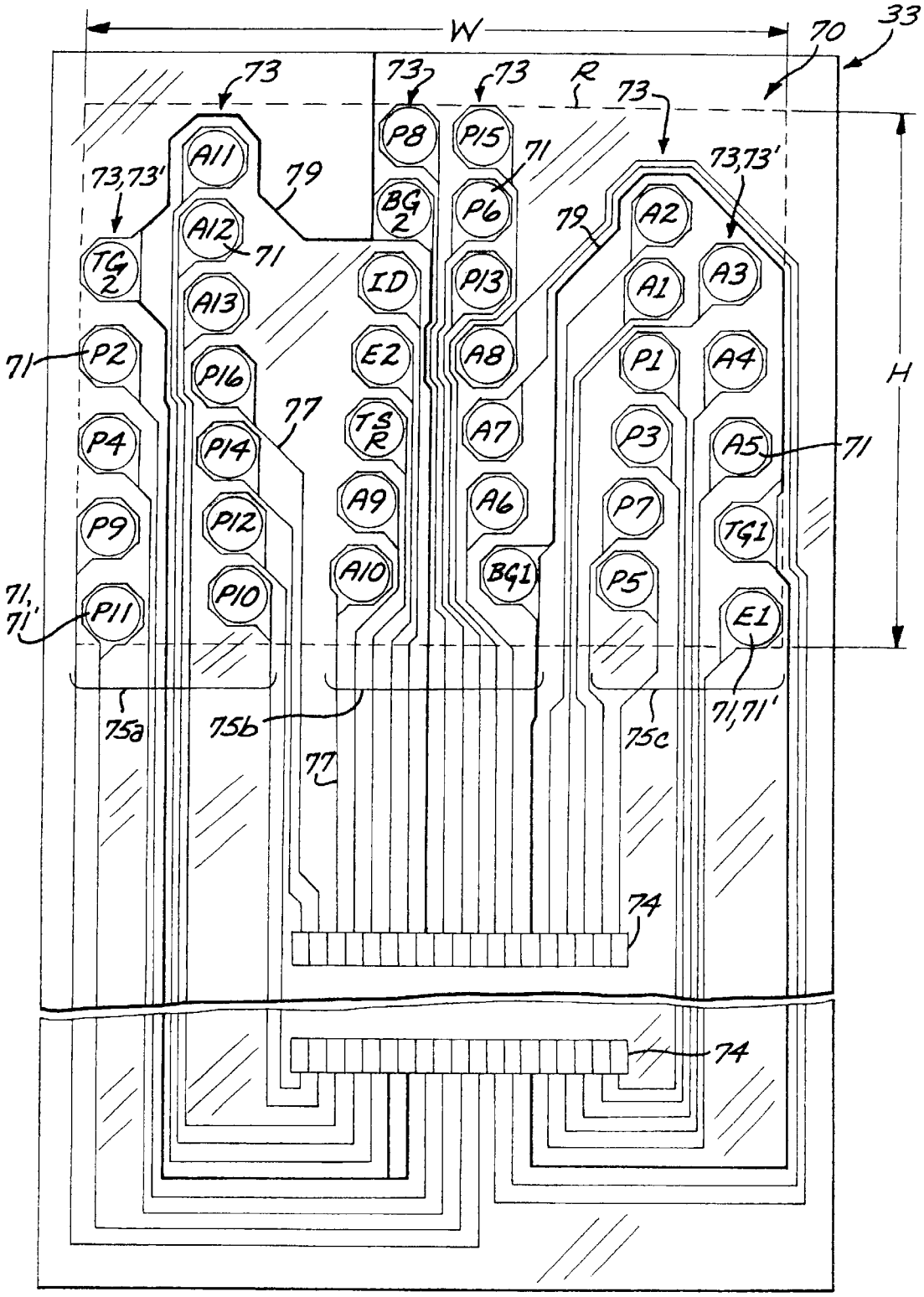
FIG. 5 is a schematic detail view of an implementation of a flexible circuit of the print cartridge of FIG. 2.

FIG. 5 is a schematic depiction of an implementation of the flexible circuit 33 which includes an array 70 of contact areas 71 that are contactively engageable from the near side of the flexible circuit 33 which is the side that is away from the cartridge body. The side of the flexible circuit 33 that is against the cartridge body is called the far side. The contact areas 71 are disposed on a portion of the flexible circuit 33 that is located on the rear wall 24, and comprise electrically conductive areas that are contactively engageable with corresponding contact bumps 139 on a resilient contact circuit 137 (FIG. 13) located in the print carriage 119 (FIG. 1). By way of illustrative example, the flexible circuit is formed of a flexible substrate such as polyimide having a conductive pattern formed on the far side thereof and openings formed in the substrate so that portions of the conductive pattern can be contacted from the near side of the flexible circuit. In such implementation, the contact areas 71 comprise conductive areas exposed by openings in the flexible substrate. The contact areas 71 can be circular, octagonal, square, square with rounded or beveled corners, or some other shape.

The contact areas 71 are more particularly arranged in a plurality of side by side, transversely separated columnar arrays 73 of contact areas 71. Each columnar array 73 includes a lower contact area that is closest to the bottom wall of the print cartridge and is also identified by the reference designation 71' for ease of reference. By way of illustrative example, the columnar arrays 73 can be substantially linear. The columnar arrays 73 in turn are arranged in side by side pairs or groups 75*a*, 75*b*, 75*c* of columnar arrays 73. As shown, there can be three pairs 75*a*, 75*b*, 75*c* of columnar arrays 73 so as to have six columnar arrays 73 of contact areas. The pairs 75*a*, 75*c* of columnar arrays 73 comprise outboard pairs, while the pair 75*b* comprises an inboard pair. Each pair of columnar arrays includes two columnar arrays 73 that diverge from each other in the direction toward the bottom wall of the cartridge.

The outermost transversely separated columnar arrays are also identified with the reference designation 73' for ease of reference. Such outermost transversely separated columnar arrays 73' can have fewer contact areas 71 than the columnar arrays 73 between such outermost transversely separated columnar arrays. By way of illustrative example, each outermost columnar array 73' includes five contact areas 71, and each of the other columnar arrays 73 includes at least six contact areas 71. By way of specific example, as shown in FIG. 5, a columnar array 73 adjacent one outermost columnar array 73' includes six contact areas while each of the other columnar arrays 73 between the outermost arrays 73' includes seven contact areas. Additionally, the outermost transversely separated columnar arrays 73' can have more contact areas 71 than the columnar arrays 73 between such outermost transversely separated columnar arrays. Also, the outermost transversely separated columnar arrays 73' can have the same number of contact areas 71 as the columnar arrays 73 between such outermost transversely separated columnar arrays.

Each columnar array 73 spans at least 70% of the height H of the smallest rectangle R that encloses the array of contact areas 71 and defines a region occupied by the contact areas 71. The height H is generally vertical. By way of specific example, the smallest rectangle R has a height H in the range of about 10 to 14 millimeters and a width W in the range of about 15 to 18 millimeters. The height to width ratio can be in range of about 0.6 to about 0.9.

The contact areas 71 of the outermost transversely separated columnar arrays 73' can be spaced center to center at about 2 millimeters from an adjacent contact area in its columnar array, for example. The contact areas 71 of the outermost transversely separated columnar arrays 73' can also be spaced center to center at less than or greater than about 2 millimeters from an adjacent contact area in its columnar array. The contact areas 71 of each of the remaining columnar arrays 73 can be spaced no closer center to center than about 1.7 millimeters from any other contact area in its columnar array, for example. Alternatively, the contact areas 71 of each of the remaining columnar arrays 73 can be spaced center to center closer than about 1.7 millimeters from any other contact area in its columnar array. A contact area 71 in any columnar array can be spaced no closer center to center than about 1.7 millimeters from a contact area in an adjacent columnar array, for example. Also, a contact area 71 in any columnar array can be spaced center to center closer than about 1.7 millimeters from a contact area in an adjacent columnar array. The lower contact areas 71' of adjacent pairs of columnar arrays 73 can be separated by at least about 2.8 millimeters center to center. Alternatively, the lower contact areas 71' of adjacent pairs of columnar arrays 73 can be separated by less than about 2.8 millimeters center to center. The lower contact areas 71' of the columnar arrays 73 between the outermost transversely separated columnar arrays 73' can be further from the bottom wall than the lower contact areas 71' of the outermost transversely separated columnar arrays 73'. Alternatively, the lower contact areas 71' can be at the same distance from the bottom wall, or they can be at different distances from the bottom wall.

Depending upon implementation, some or all of the contact areas 71, 71' are electrically connected to the printhead by conductive traces generally indicated by the reference designation 77. The conductive traces are preferably disposed on the far side of the flexible circuit 33, which is the side against the cartridge body, and lead to bond pads 74 on the printhead 15 (FIG. 4).

In FIG. 5, the contact areas include primitive select contact areas P1–P16, address signal contact areas A1–A13, enable signal contact areas E1–E2, a temperature sense resistor contact area TSR, an identification bit contact area ID, and ground line contact areas TG1, TG2, BG1, BG2.

Each of the outermost transversely separated arrays 73' can include a ground contact area (TG1, TG2), while each of the columnar arrays 73 of the inboard pair 75*b* can include a ground contact area (BG1, BG2). The ground contact area BG1 in a columnar array 73 of the inboard pair 75*b* can be electrically connected to the ground contact area TG1 in the closest outermost columnar array 73' by a ground conductive trace 79 that is routed close to the columnar arrays so as to be only on the portion of the flexible circuit that is on the rear wall of the print cartridge body. Similarly, the ground contact area BG2 in the other columnar array 73 of the inboard pair 75*b* can be electrically connected to the ground contact area TG2 in the closest outermost columnar array 73' by a ground conductive trace 79 that is close to the columnar arrays so as to be only on the portion of the flexible circuit that is on the rear wall of the print cartridge.

Figure 5A:
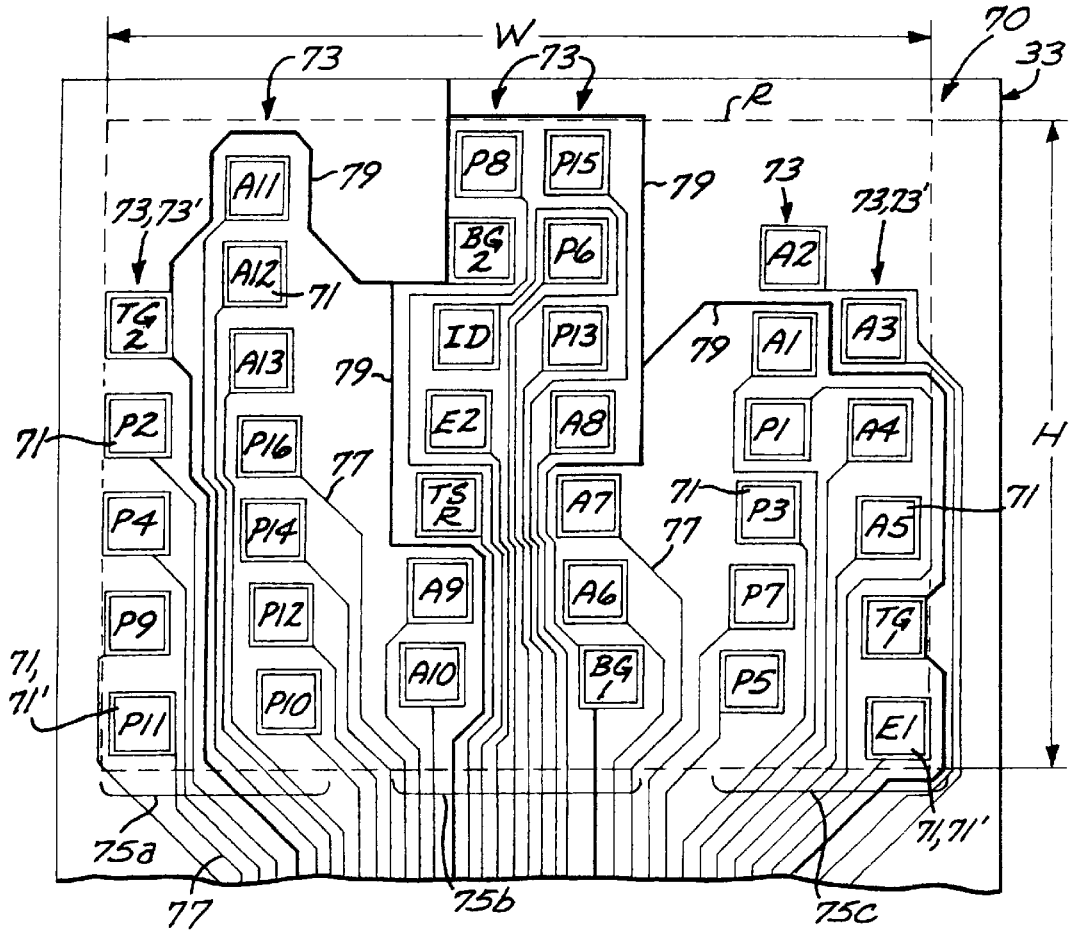
FIG. 5A is a schematic detail view of a further implementation of a flexible circuit of the print cartridge of FIG. 2.

FIG. 5A illustrates a contact array similar to that in FIG. 5, but with different routing of the conductive traces 77 and wherein all of the ground contact areas TG1, BG1, BG2, TG2 are interconnected by ground traces 79 that are on the flexible circuit. Such ground traces can more particularly be located close to the columnar arrays so as to be only on the portion of the flexible circuit that is on the rear wall of the print cartridge body.

Figure 6:
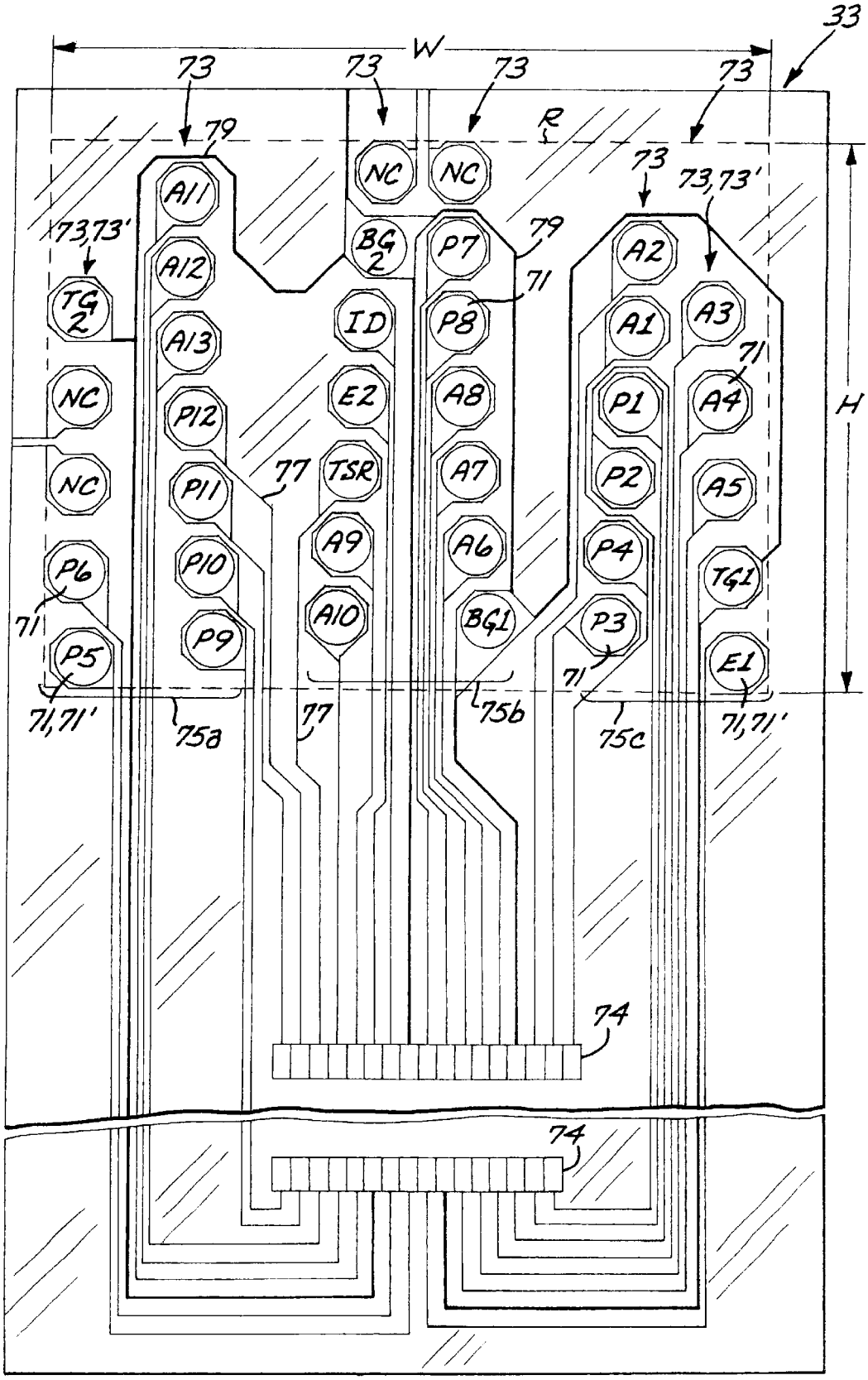
FIG. 6 is a schematic detail view of another implementation of a flexible circuit of the print cartridge of FIG. 2.

FIG. 6 shows a contact array similar to that in FIG. 5 but wherein four contact areas labeled NC are not used. Also, the contact array of FIG. 6 includes twelve primitive select contact areas P1–P12, instead of sixteen, that are in different locations. The ground contact areas TG1, TG2, BG1, BG2 are electrically interconnected by ground traces 79 that are routed close to the columnar arrays so as to be only on the portion of the flexible circuit that is on the rear wall of the print cartridge body.

The ground contact areas TG1, TG2, BG1, BG2 of the flexible interconnect circuits of FIGS. 5, 5A, 6 can be in different locations, and can be interconnected by conductive ground traces that are disposed only on the portion of the flexible circuit that is on the rear wall of the print cartridge body, for example.

Figure 7:
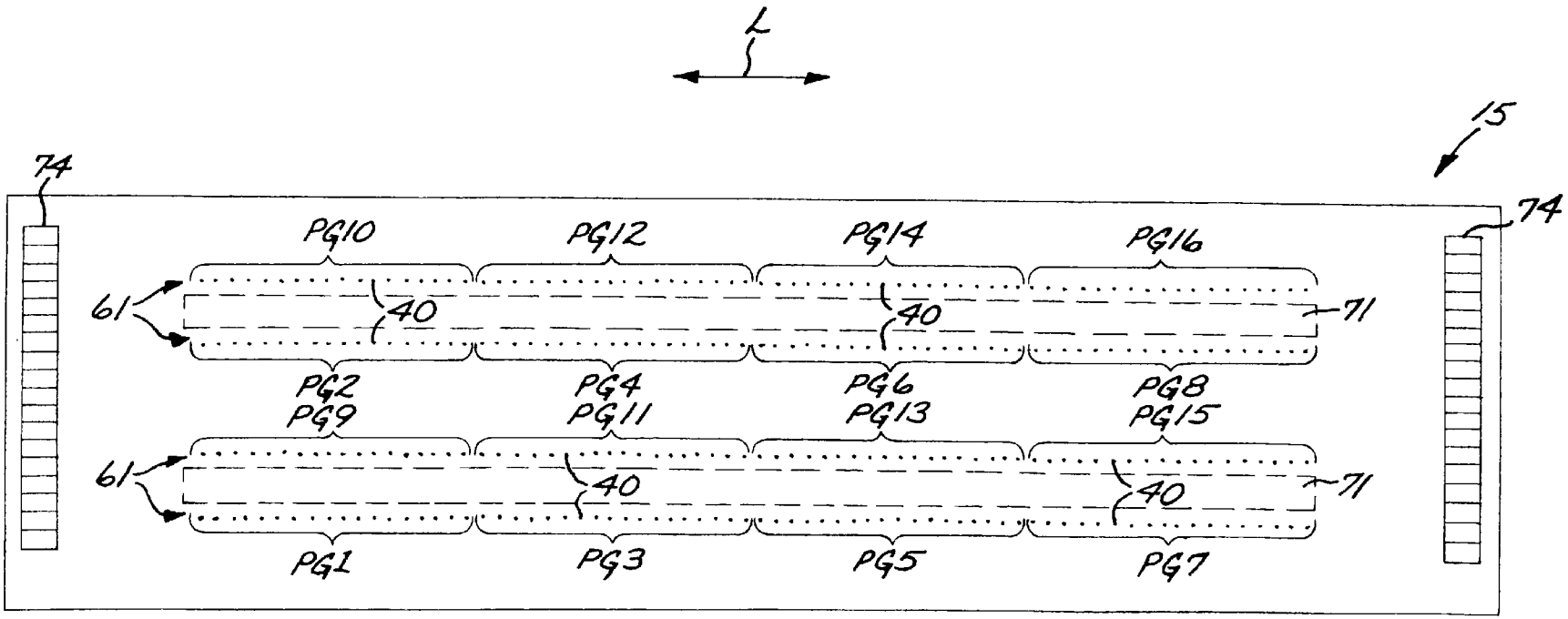
FIG. 7 is an unscaled schematic top plan illustration of a primitive group arrangement of ink drop generators of an ink jet printhead that can be incorporated in the print cartridge of FIG. 2.

Referring now to FIG. 7, set forth therein is a schematic plan view of a printhead 15 that can be employed with the flexible circuits of FIGS. 5 and 5A. The printhead includes a plurality of ink drop generators 40 arranged in a plurality of columnar arrays 61. Each columnar array is arranged in a plurality of primitive groups such that all of the arrays are arranged in primitive groups PG1–PG16, for example. Each ink drop generator comprises for example a thermal ink drop generator formed of a nozzle, an ink chamber, a heater resistor, and drive circuitry. By way of illustrative example, the ink drop generators 40 receive ink via ink feed slots 71 located adjacent the columnar arrays 61 of ink drop generators.

Figure 8:
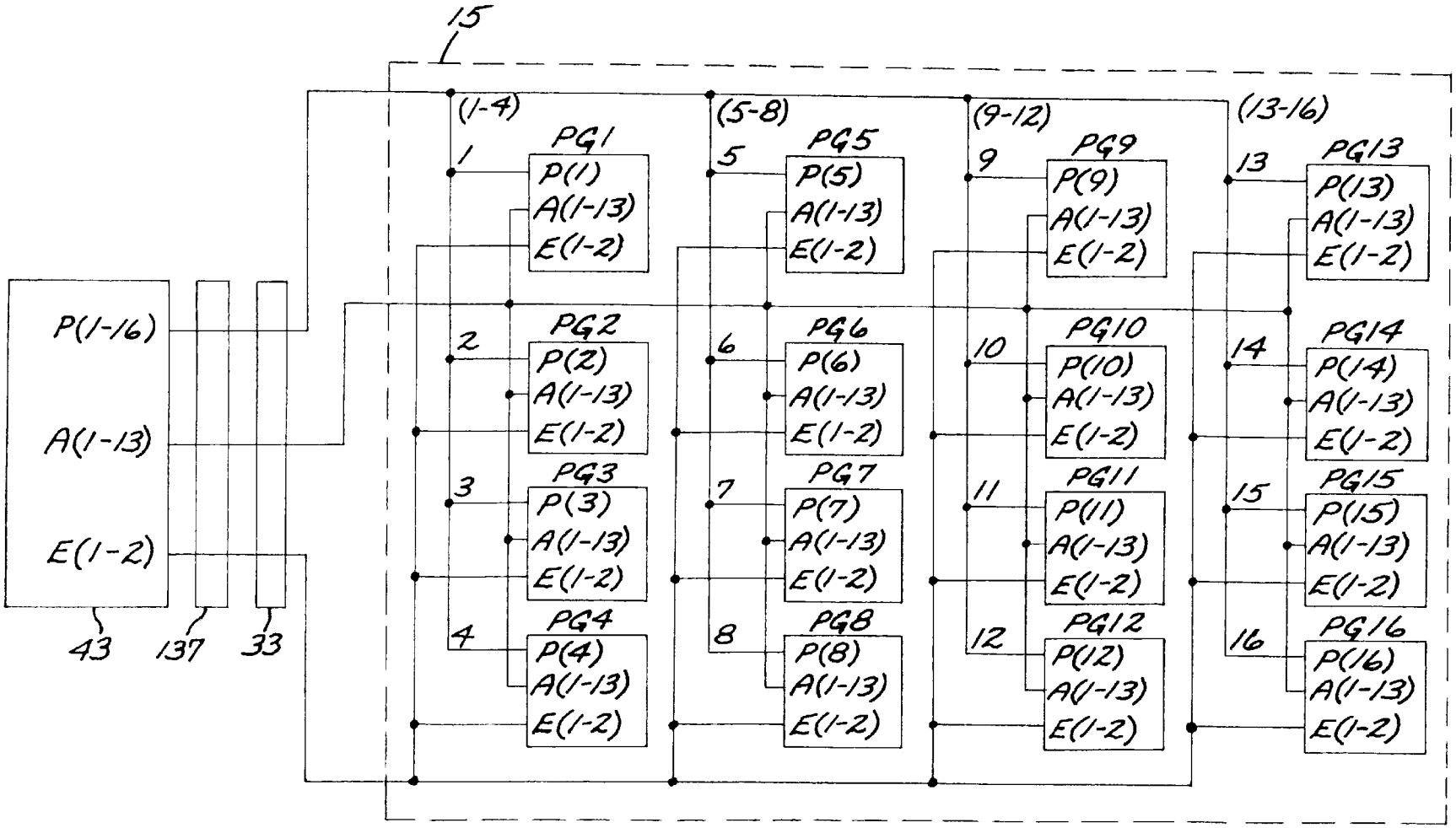
FIG. 8 is a schematic electrical block diagram illustrating the electrical connection provided by the flexible circuit between the printer and the printhead.

The ink drop generators in one of the primitive groups are switchably coupled in parallel to a respective primitive select signal (FIG. 8, P(1–16)) via an associated primitive select contact area (P1–P16) of the flexible circuit. One outboard columnar array 61 contains primitive groups PG1, PG3, PG5, PG7, while the other outboard columnar array 61 contains primitive groups PG10, PG12, PG14, PG16. One inboard columnar array includes primitive groups PG2, PG4, PG6, PG8, while another inboard columnar array contains primitive groups PG9, PG11, PG15, PG13.

FIG. 8 more particularly sets forth a simplified electrical block diagram illustrating the electrical connection provided by the flexible circuit 33 between the printer and the printhead. The printer includes a print control device 43 having a source of drive current, an address generator, and an enable generator. The source of drive current, the address generator, and the enable generator provide drive current, address signals, and enable signals to the printhead via the contact bumps 139 of the resilient contact circuit 137 (FIG. 13) that are contactively engaged with the contact areas 71 of the flexible circuit 33.

For the particular example of a printhead having sixteen primitive groups PG1–PG16, sixteen separate drive current signals or primitive select signals P(1–16) are respectively provided via the primitive select contact areas P1–P16 to the primitive groups PG1–PG16. Thirteen separate address signals A(1–13) are provided via the address contact areas A1–A13, while two enable signals E(1–2) are provided via the enable contact areas E1–E2.

More particularly as to electrical connections between the flexible circuit of FIG. 5 or 5A and the printhead of FIG. 7, primitive select contact areas P1, P3, P7, P5 in the outboard pair 75*c* of columnar arrays are electrically connected to the outboard primitive groups PG1, PG3, PG7, PG5. Primitive select contact areas P10, P12, P14, P16 in the outboard pair 75*a* of columnar arrays are electrically connected to the outboard primitive groups PG10, PG12, PG14, PG16. Primitive select contact areas P2, P4, P9, P11 in the outboard pair 75*a* are connected to inboard primitive groups PG2, PG4, PG9, PG11. Primitive select contact areas P6, P8, P13, P15 of the inboard pair 75*b* are connected to inboard primitive groups PG6, PG8, PG13, PG15.

Figure 9:
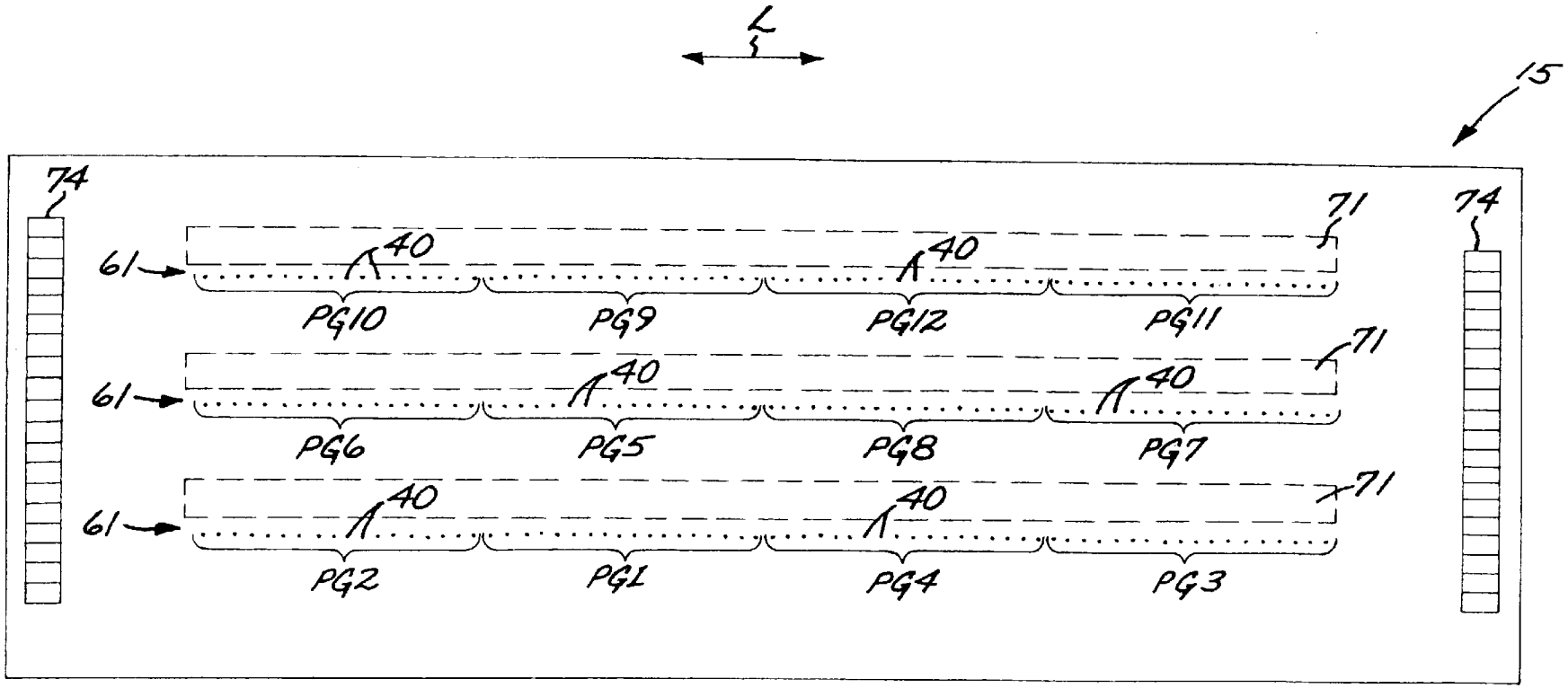
FIG. 9 is an unscaled schematic top plan illustration of a primitive group arrangement of ink drop generators of another ink jet printhead that can be incorporated in the print cartridge of FIG. 2.

Referring now to FIG. 9, set forth therein is a schematic plan view of a printhead 15 that can be employed with the flexible circuit of FIG. 6. The printhead includes a plurality of ink drop generators 40 arranged in three columnar arrays 61. Each columnar array is arranged in a plurality of primitive groups such that all of the arrays are arranged in primitive groups PG1–PG12, for example. Each ink drop generator comprises for example a thermal ink drop generator formed of a nozzle, an ink chamber, a heater resistor and drive circuitry. By way of illustrative example, the ink drop generators 40 receive ink via ink feed slots 71 located adjacent the columnar arrays 61 of ink drop generators.

The printhead of FIG. 9 is electrically connected to the printer via the flexible circuit of FIG. 6 in a manner similar to that shown in and described with respect to FIG. 7, but with twelve primitive select signals P(1–12) for the primitive groups PG1–PG12.

The ink drop generators in one of the primitive groups (PG1–PG12) are thus switchably coupled in parallel to a respective primitive select signal P(1–12) via an associated primitive select contact area (P1–P12) of the flexible circuit of FIG. 6. One outboard columnar array 61 of the printhead of FIG. 9 contains primitive groups PG1–PG4, while the other outboard columnar array 61 contains primitive groups PG9–PG12. The inboard columnar array includes primitive groups PG5–PG8.

More particularly as to the electrical connections between the flexible circuit of FIG. 6 and the printhead of FIG. 9, primitive select contact areas P1–P4 in the outboard pair 75*c* of columnar arrays are electrically connected to the outboard primitive groups PG1–PG4. Primitive select contact areas P9–P12 in the outboard pair 75*a* of columnar arrays are electrically connected to the outboard primitive groups PG9–PG12. Primitive select contact areas P5, P6 in the outboard pair 75*a* are connected to inboard primitive groups PG5, PG6, while primitive select contact areas P7, P8 in the inboard pair 75*b* are connected to inboard primitive groups PG7, PG8.

Thus, in general as to the flexible circuits of FIGS. 5, 5A and 6, and the printheads of FIGS. 8 and 9, a first outboard pair of columnar arrays of contact areas includes primitive select contact areas electrically connected to a first set of outboard primitive groups, a second outboard pair of columnar arrays of contact areas includes primitive select contact areas electrically connected to a second set of outboard primitive groups and to a set of inboard primitive groups, and an inboard pair of columnar arrays of contact areas includes primitive select contact areas electrically connected to another set of inboard primitive groups.

Referring now to FIGS. 10–17, the print carriage 119 more particularly includes a base 126 that supports the structure, and two C-shaped bearings 128 located at the ends of the base 126. These C-shaped bearings 128 slidably support the print carriage 119 on the slider rod 121. The print carriage 119 further includes two chutes 131 that each receive, hold, and align an ink jet print cartridge 11. Both chutes are constructed and operate similarly. Each chute includes a rear wall 135 that comprises for example a portion of the base 126, a left side wall 133 that extends from the rear wall 135, and a right side wall 134 that extends from the rear wall 135 and is generally parallel to the left side wall 133.

Carriage datums CY1, CZ1 and CX1 formed for example as part of the base 126 are located at the bottom of the chute 131 in the vicinity of the intersection of the left side wall 133 the rear wall 135, while carriage datums CY2 and CZ2 for example as part of the base 126 are located at the bottom of the chute 131 in the vicinity of the intersection of the right side wall 134 and the rear wall 135. A carriage datum CY3 is located on the rear wall 135.

A resilient contact circuit 137 is located on the rear wall 135 of the chute and contains electrical contacts that are urged against corresponding contacts on the flex circuit 33 of the print cartridge 11. The resilient contact circuit 137 further functions as a resilient element that urges the print cartridge datums PY1, PY2 against carriage datums CY1, CY2 when the print cartridge 11 is installed. By way of illustrative example, the resilient contact circuit 137 comprises a flexible circuit and resilient pad located between the flexible circuit and the rear wall 135.

Figure 16:
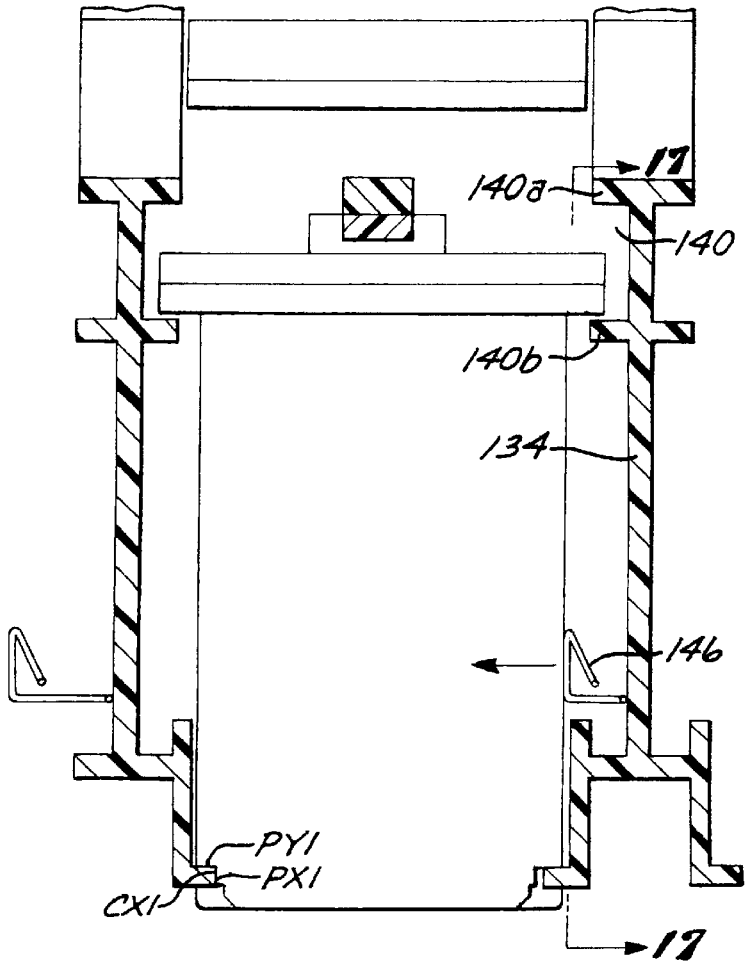
FIG. 16 is a schematic sectional elevational view of a chute of the print carriage of FIG. 10.
Figure 17:
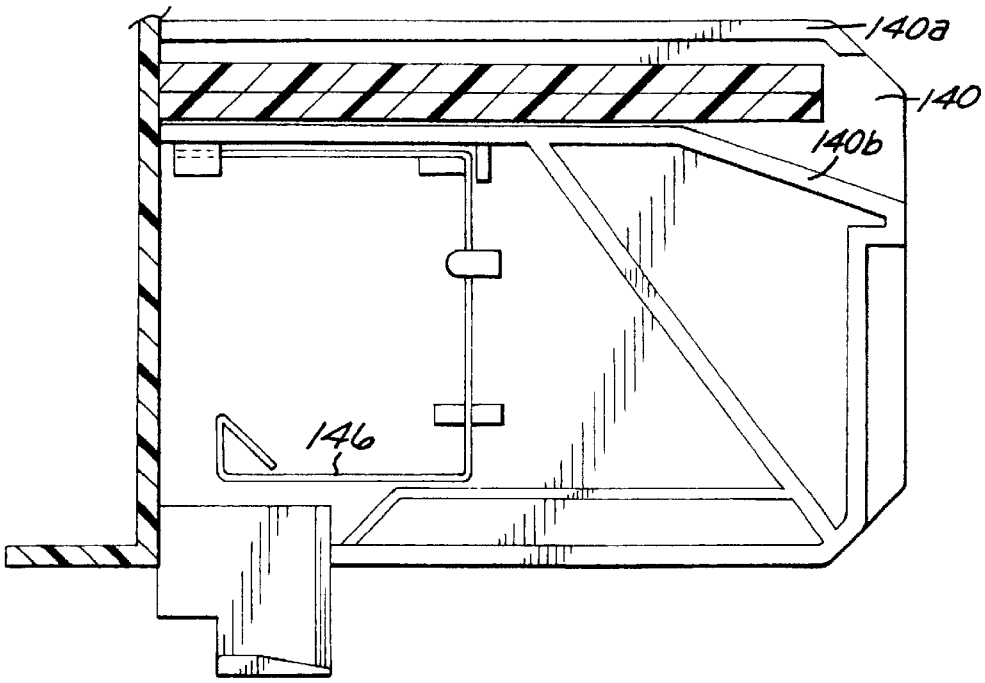
FIG. 17 is a schematic sectional elevational view of a side wall of a chute of the print carriage of FIG. 10.

A cantilever spring 146 is located adjacent the right side wall 134, and functions to urge the print cartridge away from the right side wall 134 along the X-axis, so that the print cartridge datum PX1 is snugly engaged against the carriage datum CX1 (as shown in FIG. 16).

Located in each side wall 133, 134 is a shaped guide channel 140. The guide channels 140 engage lips 29 of the lid 31 of the print cartridge 11, and guide the cartridge at an appropriate elevation and pitch (or rotation) of the cartridge about the X axis as the cartridge is inserted, so as to guide the cartridge into the general vicinity of the carriage datums. By way of illustrative example, each guide channel comprises upper and lower rails 140*a*, 140*b* or a recessed slot having appropriate sides.

A cross bar 179 (see FIG. 10) spans the upper part of the front portion of chute 131 and is located above the guide channels 140. The cross bar prevents insertion of the cartridge from above, and further prevents spreading of the side walls in the event the cartridge is forced too low in the chute.

Located at the top of each chute 131 is a hinged latch assembly 150 (FIG. 10 and FIG. 14) that includes a latch support arm 151 that is pivotally attached by a hinge 153 to the top of the rear wall 135 so as to be hingably rotatable about a hinge axis that is parallel to the X-axis. The latch support arm 151 is generally L-shaped having a first leg 151*a* that extends from the hinge 153 and a second leg 151*b* that extends generally downwardly from the distal end of the first leg 151*a*. Latch hooks 155 are located at the ends of the second leg 151*b* for engaging latch tabs 157 disposed at the front of the side walls 133, 134.

A pivoting biased clamp lever 159 is pivotally attached to the lower side of the latch arm 151 by a pivoting clamp hinge 161 that is displaced from the latch arm hinge 153 and parallel thereto so as to be pivotable about a pivoting clamp hinge axis that is parallel to the X axis. The clamp lever 159 extends generally toward the chute rear wall 135 when the latch is closed, and forms an acute angle with an imaginary line that extends between the latch arm hinge axis and the pivoting clamp hinge axis. The clamp lever 159 is biased by a spring 163 to pivot away from the latch arm 151. Stops 165 on either side of the clamp lever 159 limit the rotation of the track lever away from the latch arm 151.

A land 167 is disposed at the distal portion of the pivoting clamp 159 for pushing down on the top portion (50*b*, 50*c*') of the latch feature 50 of the print cartridge 11. Extending beyond the land 167 is an extension 169 that prevents the clamp 159 from jamming on the front latch surface 50*a* of the latch feature 50.

The pivoting clamp lever 159 further includes tracks 171 in which a sliding clamp arm 173 is slidably located for movement generally orthogonally to the pivoting clamp hinge axis. The sliding clamp arm 173 is biased by a spring 175 to slide along the pivoting clamp lever 159 away from the pivoting latch hinge 161. Stops 175 limit the displacement of the sliding clamp 173. A sliding clamp land 177 is disposed at the distal end of the sliding clamp 173 adjacent the pivoting clamp land 167.

In use, the cartridge 11 is inserted generally horizontally into the chute 131. The guide channels 140 control the elevation and the pitch about the X axis of the cartridge 11 as it is inserted into the chute 131, such that print cartridge datums PY1, PY2 move over the corresponding carriage datums CY1, CY2. The latch arm 151 is then pivoted downwardly which causes the sliding clamp land 177 and the pivoting clamp land 167 to eventually engage the front latch surface 50*a* and top portion (50*b*, 50*c*') of the latch feature 50 on the top of the cartridge. Continued displacement of the latch arm 151 causes the sliding clamp 173 to resiliently push on the latch feature generally along the Y axis, and further causes the pivoting clamp 159 to push on the latch feature generally along the Z axis. The push generally along the Y axis is independent of the push generally along the Z axis. The push along the Z axis causes the print cartridge datums PZ1, PZ2 to snugly seat against the carriage datums CZ1, CZ2. The push along the Y axis causes the print cartridge to pivot about the X axis so that the print cartridge datum PY3 snugly seats against the carriage datum CY3. The resilient contact circuit 137 is located so as to cause the print cartridge datums PY1, PY2 to seat snugly against the carriage datum CY1, CY2 when the print cartridge datums PZ1, PZ2 are engaged with the carriage datums CZ1, CZ2, and the print cartridge datum PY3 is engaged with the carriage datum CY3.

The latch arm 151 is further displaced to engage the latch hooks 155 with the latch tabs 157, which allows the sliding clamp land 177 and the pivoting clamp land 167 to continually press against the front surface 50*a* and the top portion (50*b*, 50*c*') of the latch feature 50 along the Y and Z axes so that the print cartridge datums PY1, PY2, PY3, PZ1, PZ2 are continually engaged with the corresponding carriage datums CY1, CY2, CY3, CZ1, CZ2. The wire spring 146 pushes the cartridge generally along the X axis so that the print cartridge datum PX1 is snugly engaged with the carriage datum CX1.

Although the foregoing has been a description and illustration of specific embodiments of the invention, various modifications and changes thereto can be made by persons skilled in the art without departing from the scope and spirit of the invention as defined by the following claims.

What is claimed is:

1. A print cartridge comprising:

a cartridge body having a lower portion and a vertical wall;

a printhead attached to said lower portion;

said printhead including a first outboard array of drop generators organized in a first set of primitive groups, a second outboard array of drop generators organized in a second set of primitive groups and an inboard columnar array of drop generators organized in a third set of primitive groups and a fourth set of primitive groups;

a contact array disposed on said vertical wall including a first outboard pair of columnar arrays of contact areas having contact areas electrically connected to said first set of primitive groups, a second outboard pair of columnar arrays of contact areas having contact areas electrically connected to said second set of primitive groups and said third set of primitive groups, and an inboard pair of columnar arrays of contact areas having contact areas electrically connected to said fourth set of primitive groups;

said pairs of columnar arrays of contact areas being side by side;

wherein the columnar arrays of contact areas of each pair diverge from each other in a direction toward said lower portion; and each pair spans at least 70% of a height of a region enclosing said contact array; and wherein each of said columnar arrays of contact areas includes a lower contact area, and wherein adjacent lower contact areas of adjacent pairs of columnar arrays of contact areas are separated center to center by at least about 2.8 millimeters.

2. A print cartridge comprising:

a cartridge body having a lower portion and a vertical wall;

a printhead attached to said lower portion;

said printhead including a first outboard array of drop generators organized in a first set of primitive groups, a second outboard array of drop generators organized in a second set of primitive groups and an inboard columnar array of drop generators organized in a third set of primitive groups and a fourth set of primitive groups;

a contact array disposed on said vertical wall including a first outboard pair of transversely separated and side by side columnar arrays of contact areas having contact areas electrically connected to said first set of primitive groups, a second outboard pair of transversely separated and side by side columnar arrays of contact areas having contact areas electrically connected to said second set of primitive groups and said third set of primitive groups, and an inboard pair of transversely separated and side by side columnar arrays of contact areas having contact areas electrically connected to said fourth set of primitive groups;

said pairs of transversely separated and side by side columnar arrays of contact areas being transversely separated and side by side;

wherein the columnar arrays of contact areas of each pair diverge from each other in a direction toward said lower portion; and each pair spans at least 70% of a height of a region enclosing said contact array; and wherein each of said columnar arrays of contact areas includes a lower contact area, and wherein adjacent lower contact areas of adjacent pairs of columnar arrays of contact areas are separated center to center by at least about 2.8 millimeters.

3. A print cartridge comprising:

a cartridge body having a lower portion and a vertical wall;

a printhead attached to said lower portion;

said printhead including a first outboard array of drop generators organized in a first set of primitive groups, a second outboard array of drop generators organized in a second set of primitive groups and an inboard columnar array of drop generators organized in a third set of primitive groups and a fourth set of primitive groups;

a contact array disposed on said vertical wall including a first outboard pair of columnar arrays of contact areas having contact areas electrically connected to said first set of primitive groups, a second outboard pair of columnar arrays of contact areas having contact areas electrically connected to said second set of primitive groups and said third set of primitive groups, and an inboard pair of columnar arrays of contact areas having contact areas electrically connected to said fourth set of primitive groups;

said pairs of columnar arrays of contact areas being side by side;

said columnar arrays of contact areas including respective lower contact areas disposed along a lower portion of said region; and wherein lower contact areas located between transversely outermost lower contact areas are further from said lower portion than said transversely outermost lower contact areas;

wherein all respective lower contact areas located between said transversely outermost lower contact areas are further from said lower portion than said transversely outermost lower contact areas; and wherein adjacent lower contact areas of adjacent pairs of columnar arrays of contact areas are separated center to center by at least about 2.8 millimeters.

4. A print cartridge comprising:

a cartridge body having a lower portion and a vertical wall;

a printhead attached to said lower portion;

said printhead including a first outboard array of drop generators organized in a first set of primitive groups, a second outboard array of drop generators organized in a second set of primitive groups and an inboard columnar array of drop generators organized in a third set of primitive groups and a fourth set of primitive groups;

a contact array disposed on said vertical wall including a first outboard pair of transversely separated and side by side columnar arrays of contact areas having contact areas electrically connected to said first set of primitive groups, a second outboard pair of transversely separated and side by side columnar arrays of contact areas having contact areas electrically connected to said second set of primitive groups and said third set of primitive groups, and an inboard pair of transversely separated and side by side columnar arrays of contact areas having contact areas electrically connected to said fourth set of primitive groups;

said pairs of columnar arrays of contact areas being transversely separated and side by side;

said columnar arrays of contact areas including respective lower contact areas disposed along a lower portion of said region; and wherein lower contact areas located between transversely outermost lower contact areas are further from said lower portion than said transversely outermost lower contact areas; and wherein all respective lower contact areas located between said transversely outermost lower contact areas are further from said lower portion than said transversely outermost lower contact areas; and wherein adjacent lower contact areas of adjacent pairs of columnar arrays of contact areas are separated center to center by at least about 2.8 millimeters.

5. A fluid drop ejecting cartridge comprising:

a cartridge body having a lower portion and a vertical wall;

a fluid drop ejecting device attached to said lower portion;

said fluid drop ejecting device including a first outboard array of drop generators organized in a first set of primitive groups, a second outboard array of drop generators organized in a second set of primitive groups and an inboard columnar array of drop generators organized in a third set of primitive groups and a fourth set of primitive groups;

a contact array disposed on said vertical wall including a first outboard pair of columnar arrays of contact areas having contact areas electrically connected to said first set of primitive groups, a second outboard pair of columnar arrays of contact areas having contact areas electrically connected to said second set of primitive groups and said third set of primitive groups, and an inboard pair of columnar arrays of contact areas having contact areas electrically connected to said fourth set of primitive groups;

said pairs of columnar arrays of contact areas being side by side; and wherein the columnar arrays of contact areas of each pair diverge from each other in a direction toward said lower portion; and each pair spans at least 70% of a height of a region enclosing said contact array; and wherein each of said columnar arrays of contact areas includes a lower contact area, and wherein adjacent lower contact areas of adjacent pairs of contact areas are separated center to center by at least about 2.8 millimeters.

6. An interconnect circuit comprising:

a flexible substrate having an upper portion with a contact array and a lower portion;

the contact array configured to be electrically connected to a fluid drop ejecting device that includes a first outboard array of drop generators organized in a first set of primitive groups, a second outboard array of drop generators organized in a second set of primitive groups and an inboard columnar array of drop generators organized in a third set of primitive groups and a fourth set of primitive groups;

said contact array including a first outboard pair of columnar arrays of contact areas having contact areas configured to be electrically connected to the first set of primitive groups, a second outboard pair of columnar arrays of contact areas having contact areas configured to be electrically connected to the second set of primitive groups and the third set of primitive groups, and an inboard pair of columnar arrays of contact areas having contact areas configured to be electrically connected to the fourth set of primitive groups;

said pairs of columnar arrays of contact areas being side by side; and wherein the columnar arrays of contact areas of each pair diverge from each other in a direction toward said lower portion; and each pair spans at least 70% of a height of a region enclosing said contact array; and wherein each of said columnar arrays of contact areas includes a lower contact area, and wherein adjacent lower contact areas of adjacent pairs of contact areas are separated center to center by at least about 2.8 millimeters.

* * * * *